United States Patent [19]

Nurnberger

[11] Patent Number: 4,641,873

[45] Date of Patent: Feb. 10, 1987

[54] SANITARY FECES COLLECTION DEVICE

[76] Inventor: George H. Nurnberger, 11250 Playa St., Space 85, Culver City, Calif. 90203

[21] Appl. No.: 838,410

[22] Filed: Mar. 7, 1986

Related U.S. Application Data

[63] Continuation of Ser. No. 716,454, Mar. 27, 1985, abandoned, which is a continuation-in-part of Ser. No. 590,038, Mar. 15, 1984, abandoned.

[51] Int. Cl.[4] ..... A47F 13/06

[52] U.S. Cl. ..... 294/1.4

[58] Field of Search ..... 294/1.4, 1.3, 1.5, 19.1, 294/55, 57, 53.5, 50.9, 100, 101; 15/257.1, 257.3, 257.6, 257.7, 104.8

[56] References Cited

U.S. PATENT DOCUMENTS 3,431,008 3/1969 Narita ..... 294/1.4

4,247,139 1/1981 Grieb ..... 294/1.4

4,279,437 7/1981 Goldberg ..... 294/1.4

*Primary Examiner*—James B. Marbert

*Attorney, Agent, or Firm*—Cislo & Thomas

[57] ABSTRACT

A sanitary disposable means of removal of animal feces is provided. The device comprises an elongated handle member having a hand gripping end and a scooping end. The scooping end includes a frame member for receiving and supporting a disposable container. A flap member is secured to the front portion of the rectangular support member and is operatively associated therewith for pivotal movement with a similar shaped flap of the disposable container into an open and a closed position. Finally, a handle is secured to the elongated handle member and connected by a rod to the flap member, whereby movement of the handle moves the flap member into either an open or a closed position.

8 Claims, 10 Drawing Figures

COLLAPSED CONTAINERS SHAPE

Fig. 5.
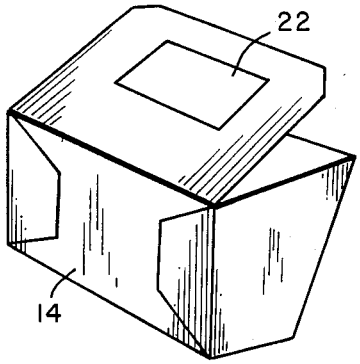
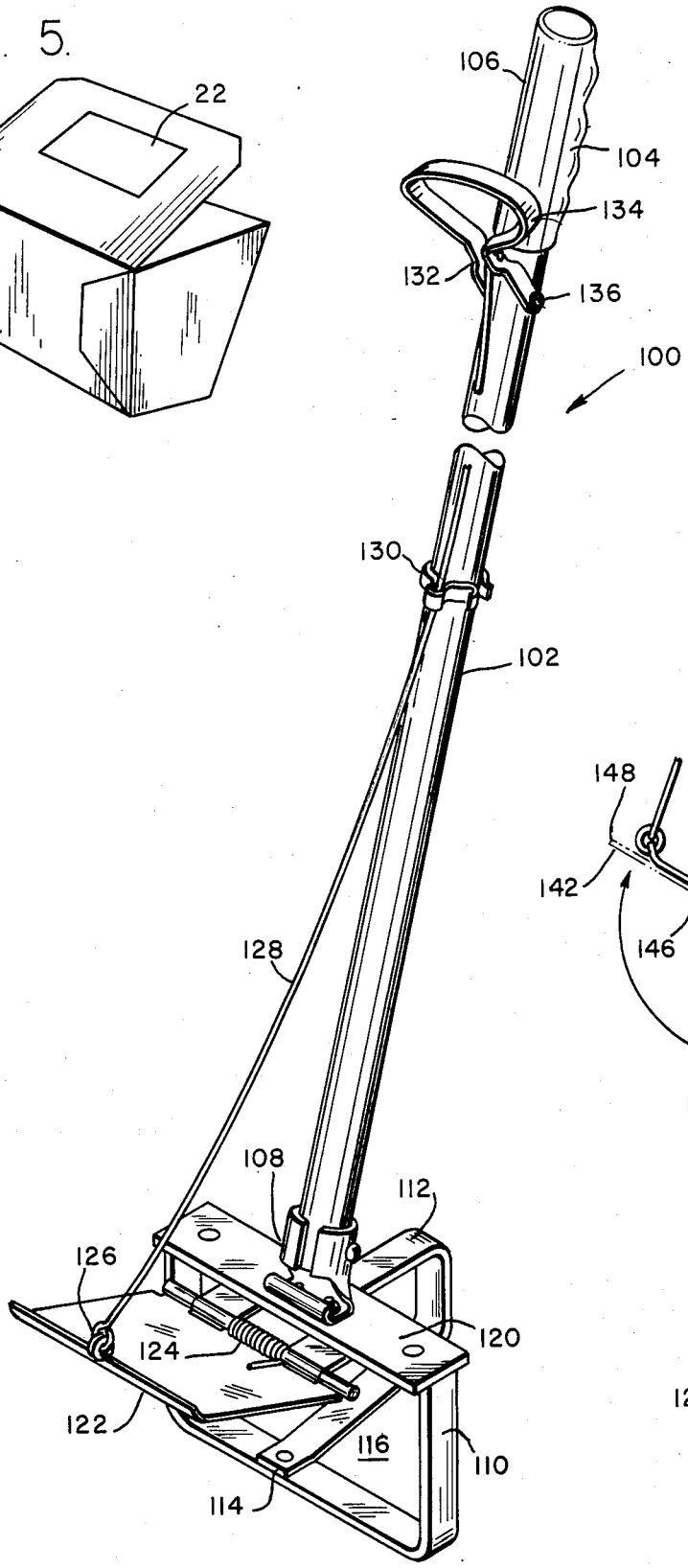
Fig. 8.
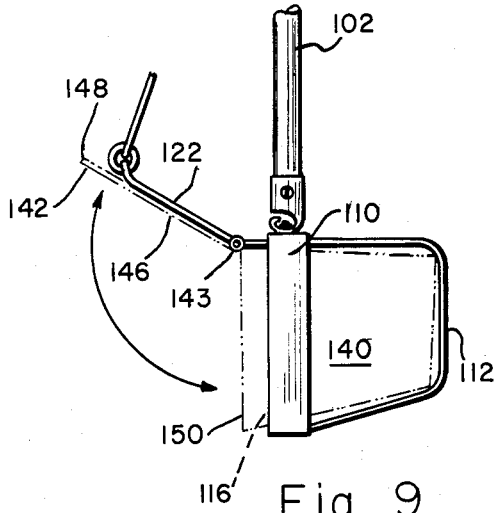
Fig. 9.
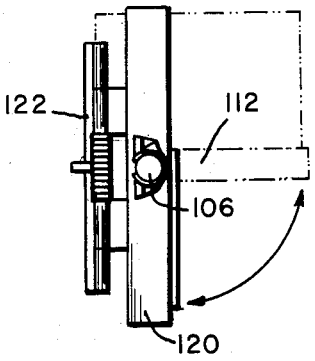
Fig. 10.

SANITARY FECES COLLECTION DEVICE

CROSS REFERENCE TO RELATED APPLICATION

This application is a continuation application of Ser. No. 716,454 filed Mar. 27, 1985 which in turn is a continuation-in-part application of Ser. No. 590,038 filed Mar. 15, 1984 now abandoned.

Due to the unhealthy, messy condition left by pet's feces after walking, a device for the sanitary personal collection has been sought. This device is easily transported by a wrist strap connected to an extended handle and safely scoops the droppings manually off of the ground into a specifically designed 2-ply or 4-play paper container, which, prior to use, is collapsible into an easily transferred folded packet and scoop, kept in one's pocket. When ready for use, the packet is then assembled and loaded into sweeper basket mechanism ready for use collection and disposal.

DESCRIPTION OF THE PRIOR ART

Previously, many designs have been patented to make the droppings removal task as healthy and simple as possible. These prior devices, shown in U.S. Pat. No. 4,316,627 by Solypa, for example, combine a finger-like shoveling device, clam-bucket in design gathering apparatus. U.S. Pat. No. 4,225,174 by Hennessy uses similar jaw type design combining the use of a plastic bag over its jaws. In U.S. Pat. No. 4,042,269 by Skermrtta, the collection receptacle acts more as a portable toilet and removable bottom to discharge the feces.

SUMMARY OF THE INVENTION

The disposable sanitary device described herein allows the person disposing feces a completely intangible exchange during disposal. An extended wooden or aluminium handle 39 inches in length with a handle grip at its very end, plus wrist strap contribute to the ease of manipulation of the manually controlled lever and sweeper basket mechanism. In operation, the scoop container is set adjacent of the droppings with a scooping motion, while simultaneously pushing lever down to close the scoop container's top, thereby confining all droppings and any odors in the container. Gathering continues until the scoop container is filled, then the device is held vertically by allowing the lever to spring snap shut, thereby locking the container's top closed. The device is held over trash can and the operating lever is lifted up to open the mechanism by nudging the bottom of the scoop container on the top edge of the trash can, thereby pushing the scoop container out of the basket and into the trash, thus demonstrating this device's sanitary means of collection and disposal. Another advantage is the simplicity of design, promoting its economical manufacture.

BRIEF DESCRIPTION OF THE DRAWINGS

FIG. 5 shows the rear tabs of the scoop container inserted, with a self stick tab on scoop container's top.

FIG. 8 is a perspective view illustrating the inventive device of the invention;

FIG. 9 is a partial schematic view illustrating how the device of the invention operates; and FIG. 10 is a fragmented view illustrating more details of construction of the inventive device.

DESCRIPTION OF THE PREFERRED EMBODIMENT

Figure 1:
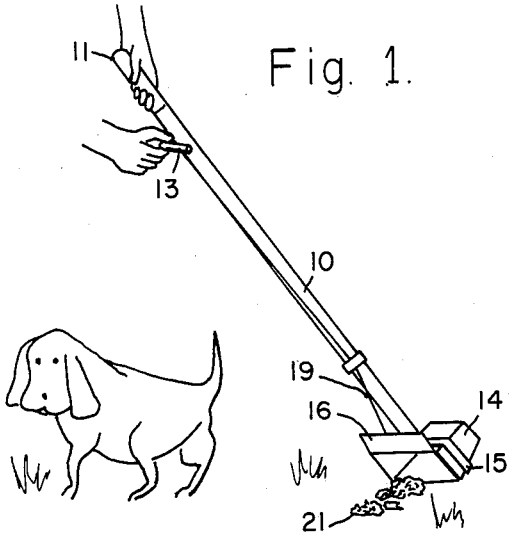
FIG. 1 shows an environmental isometric view of the lever rod operation in conjunction with the sweeper flap and basket and scoop container positioning the device.

Referring to the embodiment of the invention shown in FIGS. 1 through 7, the device is represented by the reference number 9. The sanitary collection device 9 consists of a hand held grip 11 and a wrist strap 12 used to hold the device's extended handle 10 and to position opposite scoop container 14 adjacent to feces 21. The operating lever 13 is lifted up, opening the sweeper flap mechanism 16, simultaneously opening the already assembled and loaded scoop container 14. Self stick adhesive tape 22 on scoop's top, coheses or sticks to sweeper flap mechanism 16 by means of a 3/32" metal wire 19 pivoting at a connection 17 and pivot point on the extended handle 10. Moving down the length of metal wire lever rod 19 is a retainer clip 18 which aligns metal wire lever rod 19 with its connection to the spring retractable sweeper mechanism 16 as shown in FIG. 1.

Figure 7:
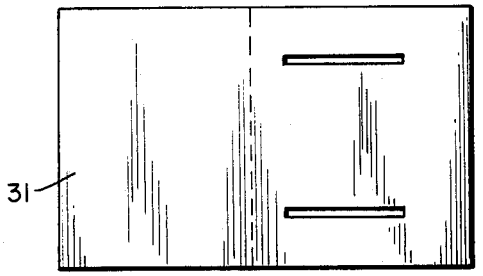
FIG. 7 shows the rectangular packet shape of the collapsed scoop container before assembly, approximately 6 inches×8 inches or 4 inches×6 inches.
Figure 4:
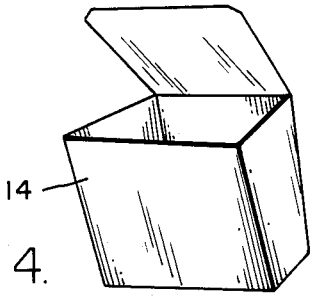
FIG. 4 shows the shape of a fully assembled scoop container.
Figure 3:
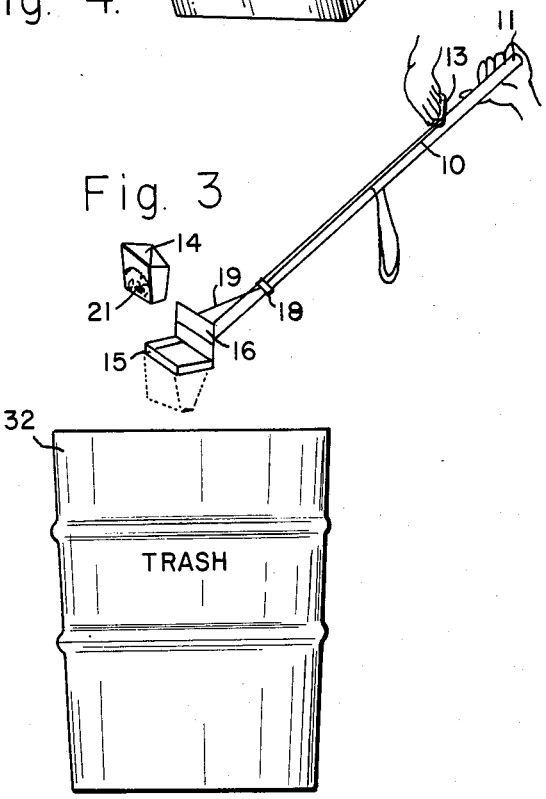
FIG. 3 depicts the technique for removing the scoop container from the basket.
Figure 6:
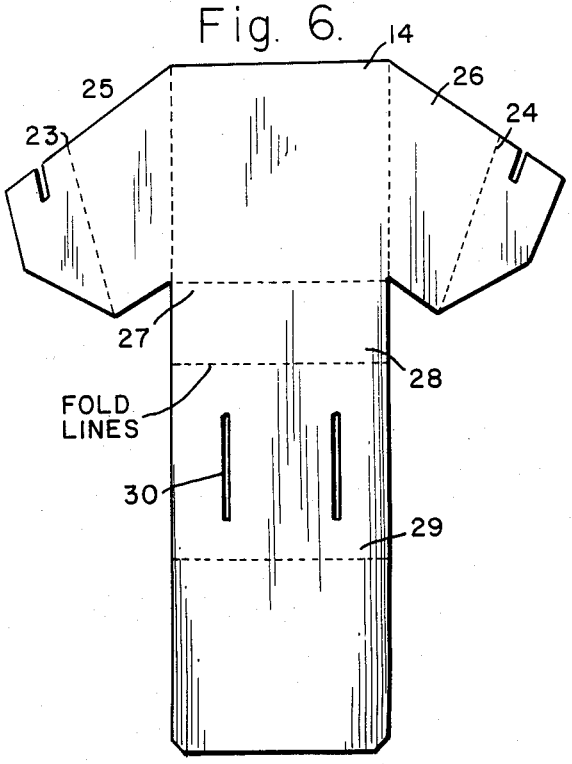
FIG. 6 shows the one piece folding assembly and collapsing lines also depicting scoop container's preassembly shape.

The disposable 4×6 or 6×8 inch scoop container packet 31 shown in FIG. 7 is folded into its collapsed shape. The packet is shown in the opened shape in FIG. 6 ready for assembly, with left tabs 23, 24 and right tabs 25, 26, left and right sides 27, 28, bottom fold lines 29 and top of scoop fold line. By assembling on these predesigned folds, the scoop container 14 is formed.

Figure 2:
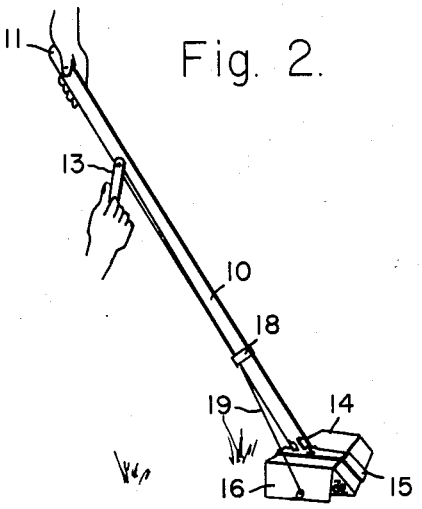
FIG. 2 shows an environmental isometric view of the lever rod operation in conjunction with the sweeper flap and basket and scoop container confining feces into disposable scoop.

Combining a sweeping, scooping motion with this device 9 as is shown in FIG. 1 and FIG. 2 simultaneously allows scoop 14 to open, then allows spring held sweeper flap 16 to close slowly, thusly confining the fecal matter and odors entirely, also allowing continuous retrieval until scoop container 14 is filled.

To lock the scoop container's 14 top before disposal, which prevents any loss of contents, lever 13 is again lifted up in its open position, opening also sweeper flap mechanism 16 and scoop container 14 lid. At this time, lever 13 is allowed to snap shut thus locking scoop container's 14 top securely. The device may now be emptied by nudging scoop container's 14 bottom pushing on trash container's 32 top edge, simultaneously lifting lever 13 up, allowing the scoop container to easily fall into trash can 32, shown in FIG. 3.

Referring to FIGS. 8, 9 and 10, the scoop 100 is shown as having an elongated handle member 102 made of wood in this instance, having a hand grasping end 104 with an appropriate handle member, such as 106 or the like, and having its opposed end 108 connected to a rigid rectangularly shaped support member 110, and connected to a C-shaped intermediate support 112, which is pivotally supported at its termini, as at 114 for example, and thereby forming an open ended support cage 116 which, as previously described, is provided to receive the disposable container as will be more fully explained.

Secured to the rectangular support member 110, from the upper bar 120, is a flap member 122 spring biased by means of spring 124 into the normally closed position so as to overlie the open end of support cage 116.

Flap member 122 has connector 126 secured to rod 128 and retained by means of clamp 130 to elongate member 102, and having an opposed end 132 rigidly secured to a handle member 134 mounted for pivotal movement by means of bolt 136 to elongate handle member 102. As can be appreciated, the movement of handle 134 actuates the flap 122 into either the open or closed position relative to, for example, container 140 disposed within the support cage 116 by reason of the retaining and support members 110 and 112.

The disposable container 140, in this particular instance, may be formed of self supporting, semi-rigid cardboard like material, having side, top and bottom walls, including a closure 142, which, because the container 140 is made integrally, may be formed by creasing, scoring or the like as at 143 so that a container may be provided which can form a closed container for receiving scooped material thereinto.

In order to have the closure 142 of disposable container 140 operate in unison with flap member 122, a double sided adhesive square, such as 146, may be provided. Additionally, in order to having a closely fitted container which would not readily dispel its contents, the closure 142 may be provided with a tab 148 which would fit into, in aligned relationship, slot 150 formed in the bottom wall of container 140.

In usage of the device 100, a disposable container like that heretofore referred to is placed within the support cage 116 with the closure element being secured to the pressure sensitive adhesive member 146, thereby allowing for cooperative movement with the closure 146 and the flap member 122.

After the material to be scooped is scooped into the interior of container 140 by reason of the lower edge of the closure 142, the handle actuator 134 allows for the scooping action into the interior of the container 140, and thereafter the material to be discarded may be taken to a trash barrel or the like, the closure member of the disposable container 140 disassociated from the adhesive strip, and the turning upside down of the device 100 will free the disposable container 140 from its retained position within the support cage 116 effectively dislodging the container 140 with the scooped material, thereby hygenically and effectively and efficiently disposing of the scooped up material.

Although the preferred embodiment shown on the sweeper flap mechanism has been fabricated of aluminium and sheet metal, it may well be made of extruded, molded plastics or combination of each, may it be understood these various changes may be within the scope of the appended claims without departing from the spirit and the scope of this invention.

I claim:

1. A scoop or the like structure comprising an elongated handle member, having a first hand gripping end and a second end operatively connected to a frame member comprising a first rectangular support member transverse to the axis of said handle member and a second intermediate C-shaped support member, lying in about the same lane as said handle member, said first rectangular suport member being connected to said second intermediate C-shaped support member and defining therebetween an open sided support cage adapted to receive a disposable member which extends outwardly from and beyond said open sided support cage and into which items are to be scooped and retained; a flap member secured to the front portion of said first rectangular support member and operatively associated therewith for pivotal movement with a congruently shaped enclosure element of said disposable member into an open and a closed position said flap member being adapted for releasable attachment to said congruently shaped enclosure element of said disposable member; and means operatively associated with said elongated handle member to actuate said flap member into either said open or closed positions.

2. The scoop in accordance with claim 1 wherein said flap member is spring biased into the normally closed position.

3. The scoop in accordance with claim 2 wherein said means to actuate said flap member comprises a handle secured to said elongated handle member and connecting a rod to said flap member and said handle member whereby movement of said handle member moves said flap member into either an open or a closed position.

4. The scoop in accordance with claim 3, including a box like disposable container made of disposable material of a size and shape to fit within said open ended support cage and to be supported therein.

5. The scoop in accordance with claim 4 wherein said disposable container is rectangular in shape and has a closure element associated therewith for movement into a closed or open position with respect to said disposable container.

6. The scoop in accordance with claim 5 wherein means on said flap member are provided in order to secure said flap member to the closure of said disposable container.

7. The scoop in accordance with claim 6 wherein said disposable container is of semi-rigid, self supporting disposable material, and wherein said closure thereof is provided with a tab and the bottom wall of said disposable container member is provided with an aligned slot so that the tab of said closure may engage said slot in a locking relationship therewith.

8. The scoop in accordance with claim 7 wherein said C-shaped member is pivotally connected to said rectangular support member at the termini thereof and is adapted to be placed in side by side relationship therewith in order to decrease the volume of said open ended support cage whereby said scoop member may be readily stored.

* * * * *